US009120197B2

(12) United States Patent
Kuehne et al.

(10) Patent No.: US 9,120,197 B2
(45) Date of Patent: Sep. 1, 2015

(54) REMOVABLE POWER-TOOL ACCESSORY HAVING A TOOL-FREE CONNECTION

(71) Applicant: BLACK & DECKER, INC., Newark, DE (US)

(72) Inventors: Brent A. Kuehne, Red Lion, PA (US); Oleksly P. Sergyeyenko, Baldwin, MD (US)

(73) Assignee: BLACK & DECKER, INC., Newark, DE (US)

( * ) Notice: Subject to any disclaimer, the term of this patent is extended or adjusted under 35 U.S.C. 154(b) by 241 days.

(21) Appl. No.: 13/797,491

(22) Filed: Mar. 12, 2013

(65) Prior Publication Data

US 2014/0273771 A1 Sep. 18, 2014

(51) Int. Cl.
*B24B 23/00* (2006.01)
*B24B 23/04* (2006.01)

(52) U.S. Cl.
CPC ..... *B24B 23/005* (2013.01); *B24B 23/04* (2013.01)

(58) Field of Classification Search
CPC ..... B24B 23/00; B24D 15/00
USPC ..... 451/357, 356, 344, 442
See application file for complete search history.

(56) References Cited

U.S. PATENT DOCUMENTS

| | | | | |
|---|---|---|---|---|
| 3,599,265 | A * | 8/1971 | D'Ercoli et al. | 15/70 |
| 5,470,272 | A * | 11/1995 | Kikuchi et al. | 451/344 |
| 5,885,144 | A * | 3/1999 | Martin et al. | 451/356 |
| 5,967,886 | A * | 10/1999 | Wuensch et al. | 451/356 |
| 6,186,878 | B1 * | 2/2001 | Takizawa et al. | 451/357 |
| 6,379,236 | B1 * | 4/2002 | Takizawa et al. | 451/490 |
| 2002/0034929 | A1 * | 3/2002 | Bode | 451/523 |

* cited by examiner

*Primary Examiner* — Robert Rose
(74) *Attorney, Agent, or Firm* — Shook, Hardy & Bacon L.L.P.

(57) ABSTRACT

A handheld power tool and a removable accessory, which is changeable without requiring extra tools, include various elements. For example, the handheld power tool includes a platen having an aperture therein and a locking mechanism coupled with the platen. The locking mechanism includes a cam member. The removable accessory includes a tab that fits into the aperture and that is engagable by the cam member to bias the removable accessory into abutting contact with the platen to securely couple the removable accessory with the tool.

21 Claims, 6 Drawing Sheets

REMOVABLE POWER-TOOL ACCESSORY HAVING A TOOL-FREE CONNECTION

BACKGROUND

Handheld power tools are generally know in which an accessory, such as a tool or a tip, can be changed to include a different configuration or is replaceable with a different accessory. For example, a handheld sanding device, commonly known as a palm sander, might include a removable tip portion designed to access corners and perform detailed work. The tip might be removed for various reasons, such as to replace the tip with a less worn or different tool or to change a configuration of the tip.

An accessory might be changed on a handheld power tool using various mechanisms. For example, some handheld power tools utilize a screw to secure the removable accessory in position. The screw can then be loosened, or removed altogether, to enable the change and then re-fastened to secure the tool back into position. However, such attachment mechanisms rely on a separate fastener (e.g., screw) and require additional tools, such as a screwdriver, to secure the fastener in place.

SUMMARY

This Summary is provided to introduce a selection of concepts in a simplified form that are further described in the Detailed Description. This Summary is not intended to identify key features or essential features of the claimed subject matter, nor is it intended to be used as an aid in determining the scope of the claimed subject matter.

Embodiments of present invention are directed to a power tool having a removable accessory, which is changeable without requiring extra tools. In one aspect, an embodiment of the present invention is directed to a handheld power tool having a platen that transmits a motion provided by a drive mechanism and that includes an aperture, a locking mechanism that is attached to the platen and that includes a cam member, and a removable accessory comprising a tab that fits into the aperture and that is engaged by the cam member.

In another aspect of the present invention, a locking mechanism is described for quickly and releasably attaching a removable accessory to a tool, the locking mechanism including a body, a cam member that extends from the body and that includes a cam surface for biasing the removable accessory, and a pivot mechanism providing a rotatable connection to the handheld power tool.

A further aspect of the present invention includes a removable accessory for a tool, the removable accessory including a body and tabs extending from the body that are insertable into respective apertures of the tool to provide a secure fit which prohibits lateral, longitudinal, and/or vertical movement of the removable accessory.

In yet another aspect of the invention, a combination of the locking mechanism and removable accessory is described. For example, the locking mechanism might include a cam member and a pivot mechanism providing a rotatable connection to the tool, and the removable accessory might include a tab configured to insert into an aperture of the tool and to be engaged by the cam member to provide a secure coupling.

BRIEF DESCRIPTION OF THE DRAWINGS

Illustrative embodiments of the present invention are described in detail below with reference to the attached figures, which are incorporated herein by reference to form part of the specification and are to be considered in conjunction with the specification, wherein.

DETAILED DESCRIPTION

The subject matter of embodiments of the present invention is described with specificity herein to meet statutory requirements. The description itself, however, is not intended to necessarily limit the scope of claims. Rather, the claimed subject matter might be embodied in other ways to include different elements or combinations of elements similar to the ones described in this document, in conjunction with other present or future technologies.

Figure 1:
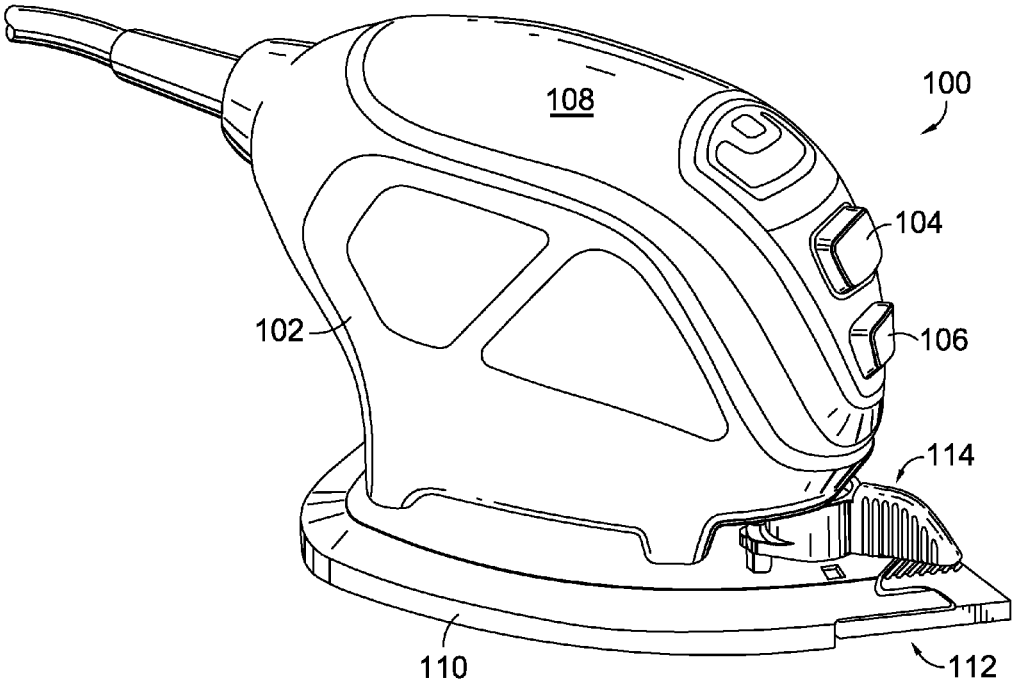
FIG. 1 is a perspective view of an sample handheld power tool having a removable accessory in accordance with an embodiment of the present invention.

When referencing the drawings, like reference characters designate like parts throughout the different views. Referring now to FIG. 1, a sample handheld power tool 100 (also referred to as "power tool") is depicted. The handheld power tool 100 comprises a motor housing 102, which encloses a motor (not depicted). In addition, the power tool 100 includes control buttons 104 and 106 that are used to control operations of the motor. When using the power tool 100, a user might grasp near an upper surface 108 of the motor housing 102 to handle and maneuver the power tool 100. The upper surface 108 might include mold-in features or a grip surface to facilitate easier grasping of the power tool 100. The handheld power tool 100 might include other elements not depicted such as a battery or other power source, one or more tools, and a dust-collection compartment. It should be noted that while the depicted sample or exemplary power tool 100 is a sander, commonly referred to as a palm sander, the present invention is not limited to use with such a tool. The present invention could be used to couple accessories to other items and/or tools, including manually operated or non-powered tools. Nonetheless, for the purpose of depicting a specific implementation or embodiment of the present invention, a handheld power sander is used.

In this embodiment of the present invention, the power tool 100 includes a platen 110 to which tools and accessories are directly or indirectly attached. For example, if the power tool 100 were being used as a handheld sanding device, an abrasive sheet could be attached to a bottom of the platen 110 to sand a work piece. That is, the platen 110 includes other features (not shown, but known in the art) that allow the abrasive sheet to attach to platen 110. Based on the orientation of the power tool 110 in FIG. 1, the abrasive sheet would attach to a bottom surface (see e.g., FIG. 2) of the platen 110.

In addition, the platen 110 is coupled with a drive mechanism of the motor, such that the motor transmits a motion provided by the drive mechanism of the motor to the platen 110. For example, the motor and drive mechanism might transmit a regular or irregular oscillation or vibration to the platen 110 and, in turn, the abrasive sheet which would then work on the surface to be abraded or sanded.

Figure 6A:
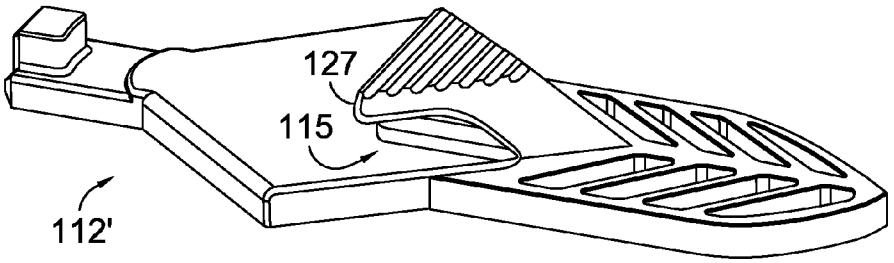
FIGS. 6*a* and 6*b* illustrate top perspective views of possible alternate embodiments of removable accessories.
Figure 6B:
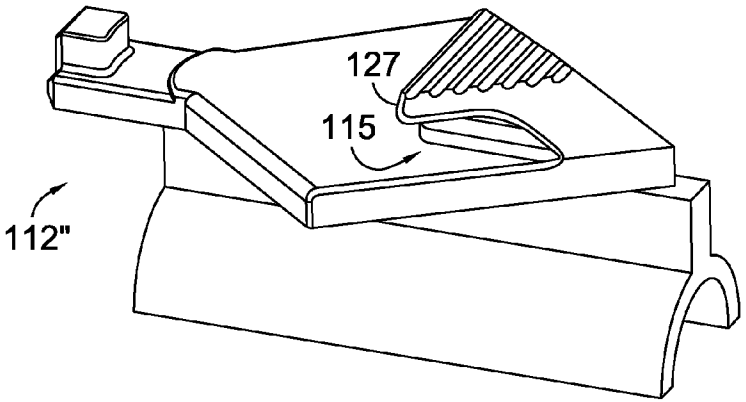

The power tool 100 also includes a removable accessory 112 that releasably attaches to or couples with the platen 110, and a locking mechanism 114 that connects and locks the removable accessory 112 to the platen 110. The removable accessory 112 might include various tools and shapes. For example, a first type of removable accessory 112 might have a triangular profile of a first width (see, e.g., removable accessory 112 in FIG. 2), whereas a second type of removable accessory might have an elongate profile with a second width, which is narrower than the first width (see, e.g., removable accessory 112' in FIG. 6*a*). As such, the first type of removable accessory might be usable to perform work across a larger surface area, whereas the second type of removable accessory might be usable to perform more detailed work. In another example, one type of removable accessory includes a substantially flat configuration for working on pieces (e.g., wood surface) having a substantially flat surface (see, e.g., removable accessory 112 in FIG. 2), whereas another type of removable accessory includes a concave configuration for working on pieces having a rounded surface (see, e.g., removable accessory 112" in FIG. 6*b*). If the power tool 100 is a sanding device, then an abrasive sheet might be coupled adjacent to a bottom surface (hidden from view) of the removable accessory 112.

In accordance with an embodiment of the present invention, the different types of removable accessories are interchangeable using the connection features of the removable accessory 112 and the locking mechanism 114. The removable accessory 112 and the locking mechanism 114 are described in more detail in other portions of this Detailed Description.

Figure 2:
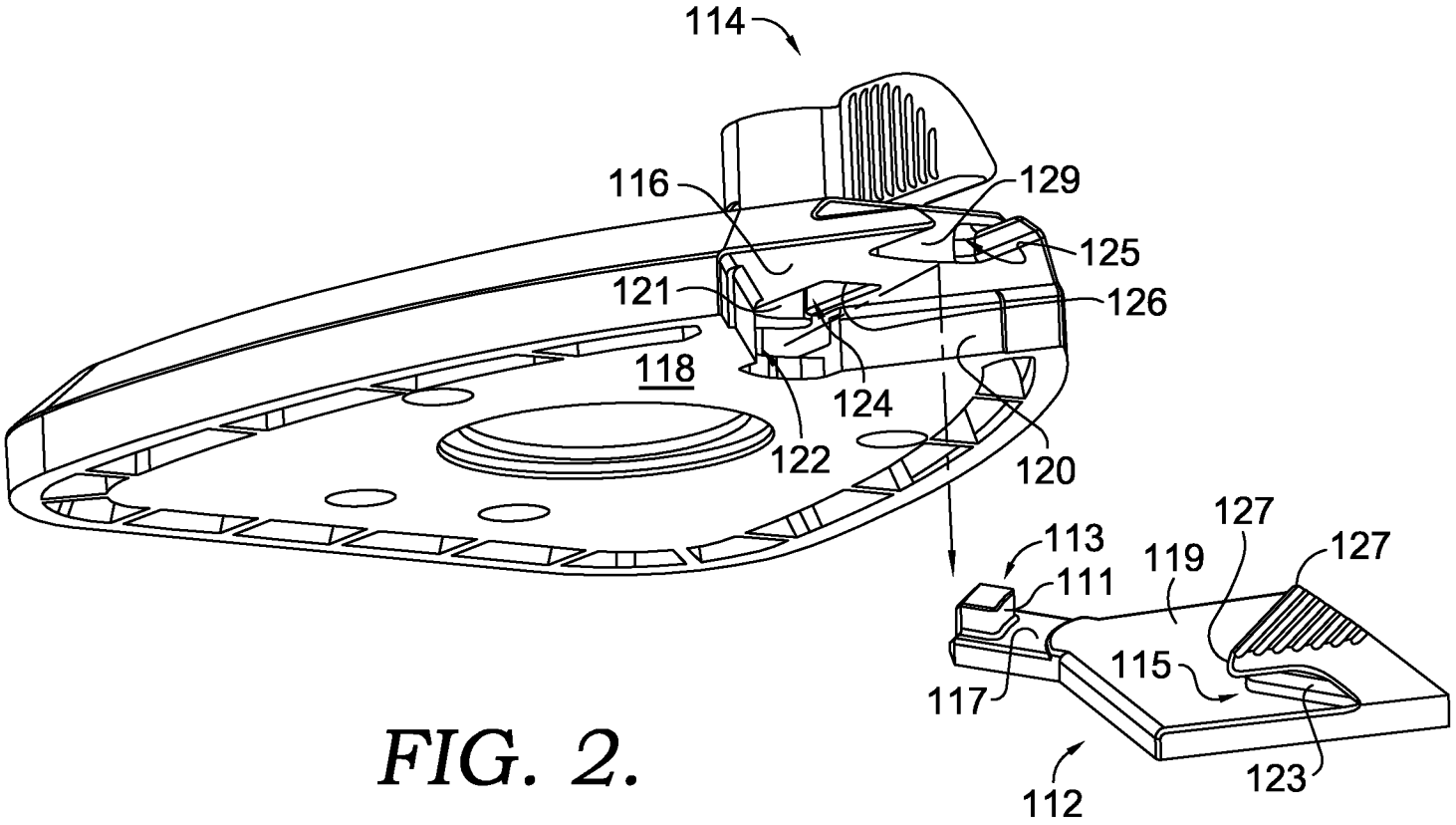
FIG. 2 is a bottom perspective view of a platen of the handheld power tool of FIG. 1 and depicts the removable accessory of FIG. 1 in accordance with an embodiment of the present invention prior to coupling with the platen.

Referring now to FIG. 2, the platen 110 is depicted from a bottom perspective, which shows the platen bottom surface that was hidden from view in FIG. 1, and the removable accessory 112 is depicted from a top perspective. The terms "bottom" and "top" are relative based on the orientation of the tool 100, and as such, the "bottom surface" might be the top surface of the platen 110 if the power tool 110 is rotated in a platen-upward orientation. The platen 110 includes a first bottom surface 116 and a second bottom surface 118. In an aspect of the present invention, one or more tools are attached adjacent to the first bottom surface 116 and the second bottom surface 118.

In addition, the platen 110 includes a wall 120 connecting the first bottom surface 116 and the second bottom surface 118. In the embodiment depicted in FIG. 2, the first bottom surface 116 is more recessed into a body portion of the platen 110 relative to the second bottom surface 118. As such, the first bottom surface 116 and the wall 120 form a partially enclosed space into which a portion of the removable accessory 112 is insertable.

The platen 110 further includes an aperture 122 extending through a thickness of the platen 110, and in the illustrated embodiment, the aperture 122 is positioned in the wall 120. In addition, the aperture 122 might also extend though the second bottom surface 118. In another aspect, the platen 110 includes a channel 124 that connects with the aperture 122. The channel 124 is constructed (e.g., molded) into the first bottom surface 116, and the channel 124 includes a first channel end 126 terminating in an interior portion of the first surface 116. A portion of the channel 124 that opposes the first channel end 126 connects with, and is continuous with, the aperture 122.

In a further aspect of the present invention, the platen 110 includes a slot 125, which also extends through a thickness of the platen 110. In one embodiment, the slot 125 is constructed into the first bottom surface 116 and extends inward from a periphery of the platen 110 towards an interior portion of the first bottom surface 116. The slot 125 includes a slot base 129, which represents a terminating end of the slot 125 and, in some regards, is similar to the wall 120. In the illustrated embodiment, the slot 125, the channel 126, and the aperture 122 are substantially aligned.

In FIG. 2, the removable accessory 112 is depicted disengaged from the platen 110. The removable accessory 112 includes a tab 113 having a cam-engaging surface 111. The removable accessory 112 also includes a flanged tab 115. In addition, the removable accessory 112 includes a finger 117 that extends from a base portion 119 and the tab 113 extends from the finger 117.

In accordance with an aspect of the present invention, the tab 113 is insertable into the channel 124 of the platen 110. In addition, the tab 113 is traversable through the channel 124 and toward the aperture 122. The finger 117 and the tab 113 include respective widths that are sized to allow the finger 117 and the tab 113 to pass through the aperture 122. In an embodiment of the present invention, a portion 121 of a cam member, which is a component of the locking mechanism 114, is rotated to not obstruct the aperture 122, thereby providing an unobstructed path through the aperture 122 through which the tab 113 and finger 117 may pass.

In a further embodiment of the present invention, the flanged tab 115 is insertable into the slot 125. The flanged tab 115 includes a trunk 123 extending from the base 119. In addition, one or more flanges 127 extends outward from the trunk 123. As such, the one or more flanges 127 are spaced apart from the base 119 of the removable accessory. In an embodiment of the present invention, the trunk 123 of the flanged tab 115 may be slid from a periphery of the platen 110 into the slot 125. When the flanged tab 115 is positioned in the slot 125, the body 119 is positioned adjacent the first bottom surface 116 of the platen 110 and the one or more flanges 127 engage a top surface of the platen 110 that generally opposes the first bottom surface 116. The top surface of the platen 110 is hidden from view in FIG. 2 and is identified by reference numeral 144 in FIG. 3. In an embodiment of the present invention, the tab 113 and the flanged tab 115 are inserted through the aperture 122 and the slot 125 (respectively) near simultaneously when connecting the removable accessory 112 to the platen 110.

In an embodiment of the present invention, a T-shaped configuration of the flanged tab 115 also contributes to a rigidity of the connection between the removable accessory 112 and the platen 110. That is, the flanges 127 engage the top surface 144 of the platen, thereby limiting movement in a vertical or first axis. In addition, the trunk 123 of the flanged tab 115 engages the slot base 129, thereby limiting movement in a longitudinal or second axis, which is substantially perpendicular to the first axis. The trunk 123 of the flanged tab 115 also engages the sides of the slot 125 to limit movement in a lateral or third axis, which is perpendicular to the first axis and the second axis.

Figure 3:
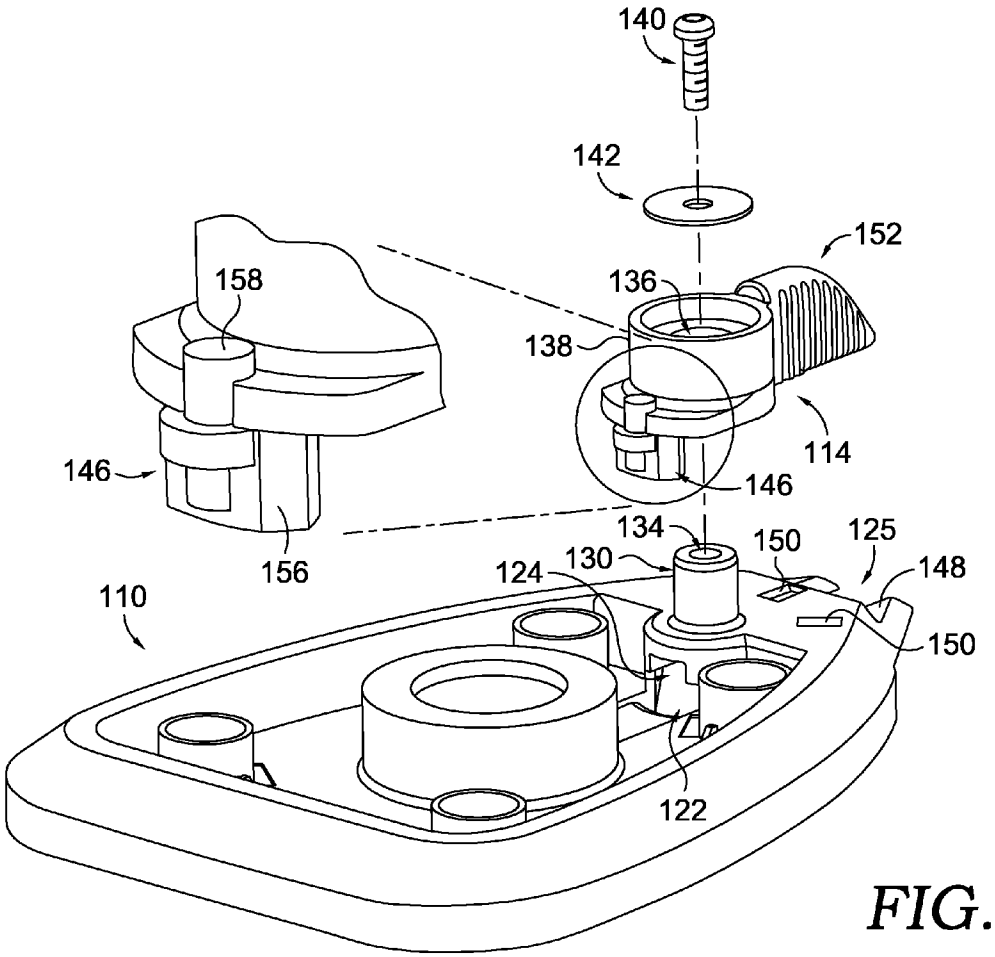
FIG. 3 is a top perspective view of the platen depicted in FIG. 2 and depicts in an exploded view various elements of a locking mechanism in accordance with an embodiment of the present invention.

Referring to FIG. 3, the platen 110 is depicted from a top perspective. In FIG. 3, another view of the aperture 122 and the channel 124 is provided. FIG. 3 depicts that the aperture 122 and a portion of the channel 124 are continuous with one another and extend through the platen 110.

The platen 110 further includes a screw boss 130. The screw boss 130 includes a periphery wall 132 that circumscribes a hollow middle region 134. The screw boss 130 mates with a pivot boss hole 136 passing through a body 138 of the locking mechanism 114. A screw 140 or other appropriate fastener is fastened inside the hollow middle region 134 when the screw boss 130 is positioned in the pivot boss hole 136. In addition, a washer 142 may be positioned between the screw head and the body 138 to reduce the risk of the locking mechanism 114 sliding off of, or otherwise breaking away from, the screw 140.

In an aspect of the present invention, a slider or cam member 146 extends from the body 138 of the locking mechanism 114. When the body 138 is secured onto the screw boss 130, the cam member 146 is movable to different positions relative to the aperture 122 and the channel 124. For example, FIG. 2 depicts an arrangement in which a portion 121 of the cam member 146 at least partially covers the aperture 122 and the channel 124. In an embodiment of the present invention, the locking mechanism 114 rotates at least partially about the screw boss 130 in order to move the cam member 146 between selectable positions. As such, the locking mechanism 114 is rotatable to move the cam member 146 to a side of the aperture 122 and the channel 124, such that the cam member 146 does not obstruct the aperture 122 and the channel 124.

An enlarged view of one embodiment of the cam member 146 is provided by FIG. 3, in which the cam member 146 includes various elements. For example, the cam member 146 includes a camming surface 156. As will be described in other portions of the Detailed Description, the camming surface 156 is usable to engage the tab 113 of the removable accessory 112 when the tab 113 is inserted through the aperture 122. In another embodiment, the cam member 146 includes a compressible member 158, such as a rubber plug or other similar device. The compressible member 158 might also engage the tab 113 in a manner similar to the camming surface 156. However, the compressible nature of member 158 allows for a greater tolerance between the cam member 146 and the tab 113.

In a further aspect of the present invention, a lever 152 extends from the body 138 of the locking mechanism 114 and is usable to rotate the body 138 about the screw boss 130. In addition, the platen 110 includes various detent pockets 150. The detent pockets 150 radially align with a detent (identified in FIG. 5 by reference numeral 164) of the locking mechanism 114. The detent 164 engages one of the detent pockets 150 in order to bias the locking mechanism 114 in a selected position.

When the aperture 122 and the channel 124 are not obstructed by the cam member 146, an unobstructed path is provided through the aperture 122 and the channel 124, and the tab 112 and the finger 117 of the removable accessory 112 may pass through the path. In addition, as described with respect to FIG. 2, the flanged tab 115 is insertable into slot 125 when the tab 113 is inserted through the aperture 122. The top surface 144 of the platen 110 is shown in FIG. 3. When the flanged tab 115 is slid into the slot 125, the flanges 127 of the flanged tab 115 engage the top surface 144 of the platen 110, as discussed above.

Figure 4A:
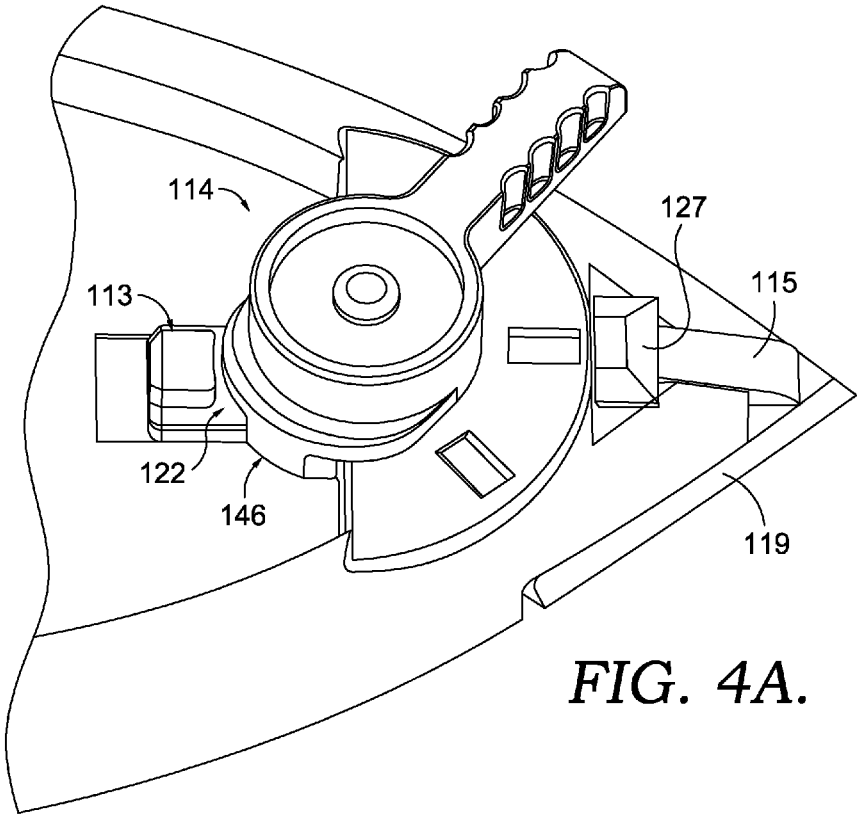
FIGS. 4*a* and 4*b* illustrate an operation of the locking mechanism in accordance with an embodiment of the present invention.
Figure 4B:
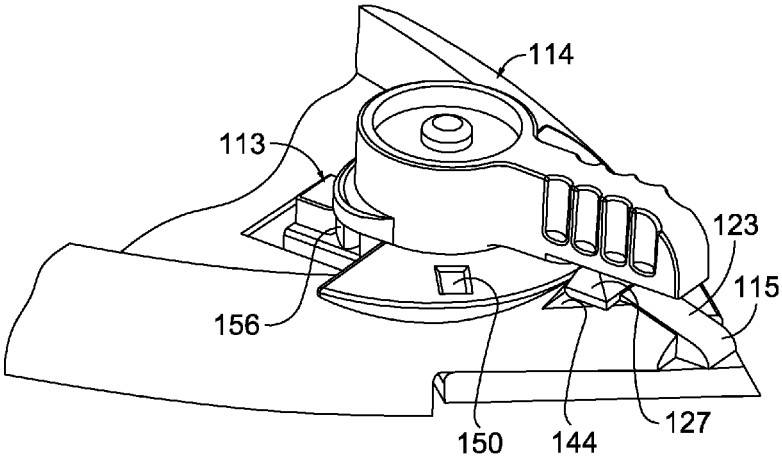

Referring now to FIGS. 4*a* and 4*b*, an operation of the cam member 146 is depicted in accordance with an embodiment of the present invention. In FIG. 4*a*, the locking mechanism 114 has been moved to an unlocked position in which the cam member 146 does not obstruct a path through the aperture 122. In addition, the tab 113 of the removable accessory 112 has been inserted through the aperture 122, and the flanged tab 115 has been inserted into the slot 125. In FIG. 4*a*, a gap exists between the cam-engaging surface 111 (FIG. 2) of the tab 113 and the platen 110. The gap intersects with a path that is traveled by the cam member 146 when the locking mechanism 114 is rotated about the screw boss 130.

In FIG. 4*b*, the locking mechanism 114 has been rotated counter-clockwise (relative to FIG. 4*a*) to a lock position, such that the cam member 146 fills the gap adjacent to the cam-engaging surface 111 of the tab 113. In accordance with an embodiment of the present invention, the camming surface 156 of the cam member 146 biases the tab 113 away from the aperture 122. In addition, such biasing action of the camming surface 156 against the tab 113 also pulls the flanged tab 115 toward the platen 110.

In an embodiment of the present invention, the removable accessory 112 depicted in FIG. 4*b* is disconnectable from the platen 110. For example, the locking mechanism 114 in FIG. 4*b* is rotatable in either a clockwise or counter-clockwise direction. Rotating the locking mechanism 114 in either direction will disengage the cam member 146 from the tab 113 and will create an unobstructed path through the aperture 122 and into the channel 124. When the tab 113 is moved through the aperture 122 and into the channel 124, the flanged tab 115 is slid out of the slot 125. When the tab 113 and the flanged tab 115 have substantially cleared the aperture 122 and the slot 125, respectively, the removable accessory 112 may be disconnected from the platen 110.

Figure 5:
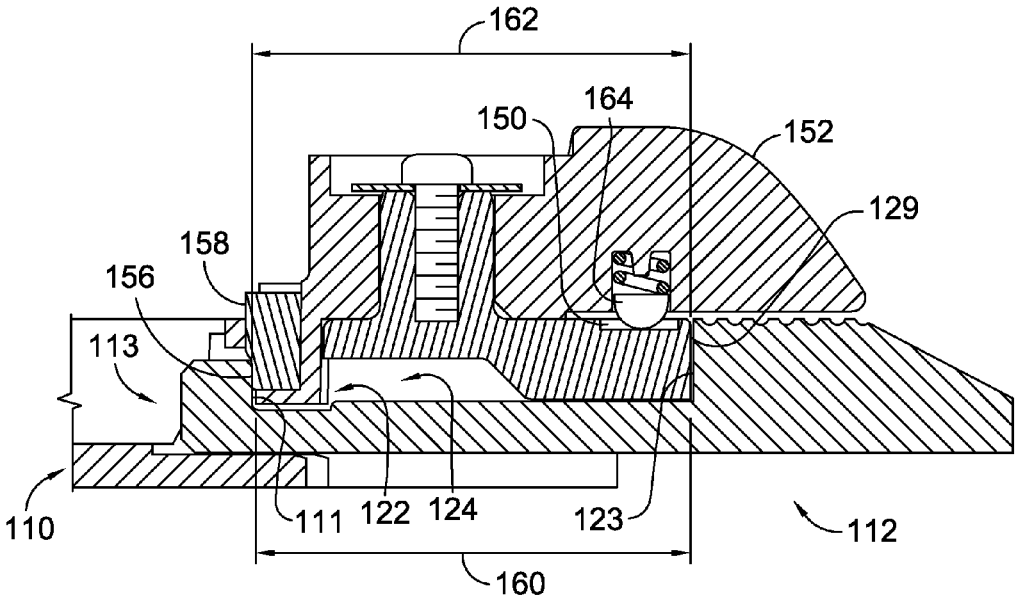
FIG. 5 is a fragmentary, side elevation view in cross-section of the platen, the locking mechanism, and the removable accessory when coupled together in accordance with an embodiment of the present invention.

Referring now to FIG. 5, a fragmentary cross-section view is provided showing the removable accessory 112 coupled to the platen 110 via the locking mechanism 114 (i.e., the locking mechanism 114 is in the same position as in FIG. 4*b*). The tab 113 of the removable accessory 112 has been inserted in the channel 124 and traversed through the channel 124 and the aperture 122. In addition, the trunk 123 of the flanged tab has been inserted into the slot 125 (not shown in FIG. 5), such that the flanged tab is abuts the slot base 129.

In an embodiment of the present invention, the cam-facing surface 111 of the tab 113 and the trunk 123 of the flanged tab 115 are spaced a distance apart, which is identified by reference numeral 160. In addition, the slot base 129 of the slot 125 is spaced a distance apart from the camming surface 156, the distance represented by reference numeral 162. In an embodiment of the present invention, the distance 160 and the distance 162 are substantially similar. As such, when camming surface 156 biases the tab 113 away from the aperture 122, the trunk 123 of the flanged tab 115 is pulled into the slot base 129 of the platen 110 and into abutting contact with the slot base 129, thereby creating a secure connection between the removable accessory 112 and the platen 110. As described in other parts of this Detailed Description, an embodiment of the present invention includes a compressible member 158 that is coupled to the cam member 146 and that compressibly engages the cam-engaging surface 111 of the tab 113. The compressible member 158 helps to account for different sized gaps between the cam-engaging surface 111 and the cam member 146 created by tolerances in the manufacturing process.

FIG. 5 also depicts one of the detent pockets 150. In an aspect of the present invention, the detent 164 is received in and underneath of the lever 152 and a ball of the detent 164 that is biased downwardly engages the detent pockets 150 as the locking mechanism 114 is rotated. As such, the detent 164 provides a friction fit with the detent pockets 150 to bias the locking mechanism in a selected position.

Many different arrangements of the various components depicted, as well as components not shown, are possible without departing from the scope of the claims below.

Embodiments of the technology have been described with the intent to be illustrative rather than restrictive. Alternative embodiments will become apparent to readers of this disclosure after and because of reading it. For example, while the illustrated embodiments are described herein as having a cam member, the use of the word cam should not be narrowly defined, but should be broadly interpreted to cover objects of any shape, which can rotate or move in an alternate path (e.g., such as a straight line), and perform the function of closing the gap between the cam-engaging surface 111 (FIG. 2) of the tab 113 and the cam member 146, as the cam member is moved and which bias the tab 113 in a direction to draw the accessory 112 into abutting contact with the platen 110 (e.g., a wedge or other item with an inclined face or surface). Alternative means of implementing the aforementioned can be completed without departing from the scope of the claims below. Certain features and subcombinations are of utility and may be employed without reference to other features and subcombinations and are contemplated within the scope of the claims.

Claimed are:

1. A handheld sanding device comprising:

a platen that transmits a motion provided by a drive mechanism and that includes a through-hole aperture extending through a thickness of the platen to create a through-passage extending from a first side of the platen to a second side of the platen;

a locking mechanism attached to the platen on the first side, the locking mechanism comprising a cam member that is movable between an unlock position and a lock position; and a removable accessory comprising a tab that fits into the through-hole aperture of the platen to pass the tab from the second side to the first side, wherein the cam member engages the tab on the first side of the platen when the tab is passed through the through-hole aperture from the second side to the first side and the cam member is moved to the lock position.

2. The handheld sanding device of claim 1, wherein the platen further comprises a slot and the removable accessory further comprises a flanged tab, and wherein the flanged tab is received in the slot when the tab is positioned through the through-hole aperture.

3. The handheld sanding device of claim 2, wherein the flanged tab includes one or more flanges, and wherein the one or more flanges are biased toward the platen when the cam member is moved to the lock position.

4. The handheld sanding device of claim 2, wherein the platen comprises a channel that has a length and that connects with the through-hole aperture, and wherein the tab is slidable through the channel when the tab is positioned into the through-hole aperture.

5. The handheld sanding device of claim 4, wherein the slot that receives the flanged tab includes a slot base, wherein a first distance exists between the tab and the flanged tab, wherein a second distance exists between the slot base and a camming surface of the cam member when the cam member is moved to a lock position, and wherein the first distance and the second distance are substantially similar.

6. The handheld sanding device of claim 1, wherein the cam member includes a camming surface that provides a force against the tab when the tab is positioned through the through-hole aperture and the cam member is moved to the lock position, and wherein the camming surface biases the tab away from the through-hole aperture when the cam member is moved to the lock position.

7. The handheld sanding device of claim 6, wherein the cam member further comprises a compressible member, and wherein the compressible member engages the tab when the tab is positioned through the through-hole aperture and the cam member is moved to the lock position.

8. The handheld sanding device of claim 1, wherein the platen includes a recessed portion that houses a portion of the removable accessory, wherein the recessed portion includes a wall, and wherein the through-hole aperture extends through the wall.

9. The handheld sanding device of claim 1, wherein the platen includes a pivot boss, wherein the locking mechanism includes a body having a pivot-boss aperture that mates with the pivot boss, and wherein the body is rotatably coupled to the pivot boss, such that the cam member is movable between the unlock position and the lock position when the body rotates about the pivot boss.

10. The handheld sanding device of claim 9, wherein the locking mechanism includes a lever that is usable to rotate the body about the pivot boss.

11. The handheld sanding device of claim 1, wherein the locking mechanism further includes a detent that engages the platen to hold the locking mechanism in at least one of the locked position and the unlocked position.

12. A removable accessory for a tool, the removable accessory comprising:

a base;

a tab that extends from the base and is insertable through a first aperture in the tool to engage a cam member; and a flanged tab that extends from the base and is receivable in a slot in the tool, wherein the flanged tab includes a trunk extending from the base, and wherein one or more flanges extend from the trunk to form a T-shaped configuration.

13. The removable accessory of claim 12 further comprising a finger extending from the base, and wherein the tab extends from the finger.

14. The removable accessory of claim 12, wherein the one or more flanges are spaced a distance apart from the base, and wherein the distance is substantially similar to a thickness of a portion of a platen of the tool, such that when the flanged tab is inserted in the slot, the platen is positioned between the one or more flanges and the base.

15. The removable accessory of claim 12, further comprising, an abrasion tool extending from the base.

16. A locking mechanism for attaching a removable accessory to a tool, the locking mechanism comprising:

a body;

a cam member extending from the body, the cam member including a camming surface for biasing the removable accessory, the camming surface including a compressible member; and a pivot mechanism providing a rotatable connection to the tool by rotating the body around the pivot mechanism to engage the removable accessory with the compressible member.

17. The locking mechanism of claim 16, wherein the pivot mechanism includes a pivot-boss aperture for receiving a boss of the tool.

18. The locking mechanism of claim 16 further comprising, a detent for engaging the tool to secure the locking mechanism in a selected position when rotated about the pivot mechanism.

19. The locking mechanism of claim 16 further comprising, a lever extending from the body for applying a rotation to the locking mechanism.

20. A removable accessory and locking mechanism combination for a tool, the combination comprising:

a locking mechanism comprising:

a cam member; and a pivot mechanism providing a rotatable connection of the locking mechanism to the tool; and a removable accessory comprising:

a tab configured to insert through a first aperture in the tool, wherein the cam member engages the tab to secure the removable accessory to the tool; and a flanged tab configured to be received in a slot in the tool, the slot extending from a periphery edge of a platen of the tool inward into an interior portion of the platen.

21. The combination of claim 20, wherein the cam member engages the tab and biases flanged tab into abutting contact with the tool to securely couple the removable accessory with the tool.

* * * * *